US005556682A

United States Patent [19]

Gavin et al.

[11] Patent Number: 5,556,682

[45] **Date of Patent: * Sep. 17, 1996**

[54] FIBROUS GLASS INSULATION ASSEMBLY

[75] Inventors: Patrick M. Gavin, Newark; Jean E. Schelhorn, Granville; David P. Aschenbeck, Newark; Carl R. Strauss, Granville, all of Ohio

[73] Assignee: Owens Corning Fiberglas Technology, Inc., Summit, Ill.

[ * ] Notice: The term of this patent shall not extend beyond the expiration date of Pat. No. 5,466,504.

[21] Appl. No.: 521,081

[22] Filed: Aug. 29, 1995

Related U.S. Application Data

[63] Continuation-in-part of Ser. No. 236,068, May 2, 1994, Pat. No. 5,466,504.

[51] Int. Cl.[6] ..... B32B 5/16; B32B 1/06

[52] U.S. Cl. ..... 428/74; 428/913; 52/406.1; 52/406.2

[58] Field of Search ..... 428/68, 69, 74, 428/913; 52/406.1, 406.2, 406.3

[56] References Cited

U.S. PATENT DOCUMENTS

| | | | |
|---|---|---|---|
| 3,782,081 | 1/1974 | Munters | 55/278 |
| 4,040,804 | 8/1977 | Harrison | 55/158 |
| 4,668,551 | 5/1987 | Kawasaki et al. | 428/69 |
| 4,749,392 | 6/1988 | Aoki et al. | 55/387 |
| 5,018,328 | 5/1991 | Cur et al. | 50/406 |
| 5,114,003 | 5/1992 | Jackisch et al. | 206/204 |
| 5,130,018 | 7/1992 | Tolman et al. | 210/172 |
| 5,137,747 | 8/1992 | Malandain et al. | 427/4 |
| 5,316,816 | 5/1994 | Sextl et al. | 428/69 |

*Primary Examiner*—Alexander Thomas

*Attorney, Agent, or Firm*—C. Michael Gegenheimer; Harold C. Knecht, III

[57] ABSTRACT

An improved fibrous glass insulation assembly (10) having a fibrous glass body (12), a moisture barrier (14) that substantially encloses the fibrous glass body (12), and a desiccant (18) positioned adjacent the fibrous glass body (12) and within the moisture barrier (14). The fibrous glass body (12) is sufficiently encapsulated or enclosed by the moisture barrier (14), the moisture barrier (14) sufficiently retards the passage of moisture therethrough, and the desiccant (18) is disposed in a sufficient quantity so that enough moisture is removed to improve the recovery performance of the fibrous glass body (12), from a recoverable compressed state, and/or to improve the stiffness performance of the fibrous glass body (12), once the glass body (12) has recovered. Thus, by improving the stiffness performance, the present invention can make it easier to install the recovered fibrous glass body (12), and by improving the recovery performance, the present invention can result in the installed fibrous glass body (12) exhibiting better insulation characteristics.

20 Claims, 3 Drawing Sheets

FIBROUS GLASS INSULATION ASSEMBLY

CROSS-REFERENCE TO RELATED APPLICATION

The present application is a continuation-in-part of U.S. patent application Ser. No. 08/236,068, filed May 2, 1994 now U.S. Pat. No. 5,466,504 and entitled IMPROVED FIBROUS GLASS INSULATION ASSEMBLY, which is assigned to the assignee of the present application.

TECHNICAL FIELD

The present invention is related to fiber insulation assemblies and, in particular, to fibrous glass insulation assemblies used in insulating homes, other buildings and the like.

BACKGROUND ART

Glass fiber insulation assemblies are known in the art. Often these assemblies include a fibrous glass body and an outer plastic layer. These insulation assemblies are often stored with the fibrous glass body in a recoverable compressed state. Sometimes the outer layer is removed prior to installation in the field. Other times, the entire encapsulated insulation assembly is installed in the field.

It has been found that, if the fibrous glass insulation assembly is stored for a period of time, for example six weeks, the recovery (i.e., recovered thickness) of the fibrous glass body from the compressed state to an uncompressed state diminishes, such as when the assembly is unrolled or otherwise prepared for installation. It has been discovered that the loss of recovery during storage can be reduced by reducing the moisture content of the fibrous glass body (i.e., reducing the amount of moisture in contact with the fibrous glass body). The insulating qualities of such a fibrous glass insulating assembly are directly impacted by its recovery performance (i.e., the recovered thickness of the assembly upon being opened after a long-term storage). It is also believed that the presence of moisture can impair the stiffness of the fibrous glass body, as well. Maintaining the stiffness of the fibrous glass body can help make installation of the insulation assembly easier.

Accordingly, the present invention is directed to an improved fibrous glass insulation assembly in which moisture is removed or significantly reduced from the fibrous glass body while the assembly is stored or otherwise awaiting installation.

DISCLOSURE OF INVENTION

The present invention is directed to an improved fibrous glass insulation assembly having a fibrous glass body, a moisture barrier that substantially encloses the fibrous glass body, and a desiccant positioned adjacent the fibrous glass body and within the moisture barrier. The fibrous glass body is sufficiently encapsulated or enclosed by the moisture barrier, the moisture barrier sufficiently retards the passage of moisture therethrough, and the desiccant is disposed in a sufficient quantity so that enough moisture is removed to improve the recovery performance of the fibrous glass body, from a recoverable compressed state, and/or to improve the stiffness performance of the fibrous glass body, once the glass body has recovered. Thus, by improving the stiffness performance, the present invention can make it easier to install the recovered fibrous glass body, and by improving the recovery performance, the present invention can result in the installed fibrous glass body exhibiting better insulation characteristics.

The present fibrous glass insulation assembly often includes a fibrous glass body (e.g., a glass fiber wool body) that is long and relatively narrow with opposite ends. Such an insulation assembly is typically folded one or more times or wound into a roll before being shipped or stored. In one type of insulation assembly adaptable according to the present invention, the moisture barrier covers a majority of the fibrous glass body except for one or both ends.

The moisture barrier is adapted to at least retard, if not fully prevent, the passage of moisture into the fibrous glass body. Exactly what threshold level of moisture in the fibrous glass body is acceptable will likely vary. The amount and distribution of the desiccant needed to keep the moisture content, in a particular fibrous glass body, below the threshold level can be ascertained by simple trial and error experimentation.

It is desirable for the moisture barrier to comprise a pliable layer (e.g., a plastic layer) that is readily formable around the fibrous glass body.

Other embodiments of the improved fibrous glass insulation assembly include a plurality of fibrous glass bodies, for example glass fiber batts, which are disposed in a bag or otherwise packaged together with the desiccant disposed within the packaging so as to substantially remove enough moisture from the packaged fibrous glass bodies to produce the desired effect.

The packaging itself can provide the moisture barrier for all of the fibrous glass bodies, a separate moisture barrier (applied before the bodies are packaged) can be provided for each fibrous glass body or a combination of both can be used, as desired. When the fibrous glass bodies are to be kept in a recoverable compressed state for a period of time, the packaging can be adapted to maintain the bodies in that compressed state. Alternatively or in conjunction therewith, at least one moisture barrier layer can be adapted and applied to keep each fibrous glass body in such a state.

The present fibrous glass insulation assembly is usually in a non-evacuated state. However, the present invention is not intended to be so limited. For example, it may be desirable to at least partially evacuate or otherwise store the fibrous glass insulation assembly in a partially evacuated state as a way to extend the effectiveness of the desiccant. The package could also be evacuated as a way to maintain the fibrous glass bodies in a compressed state.

MODES FOR CARRYING OUT THE INVENTION

Although the present invention is herein described in terms of specific embodiments, it will be readily apparent to those skilled in this art that various modifications, rearrangements, and substitutions can be made without departing from the spirit of the invention. The scope of the present invention is thus only limited by the claims appended hereto.

Figure 1:
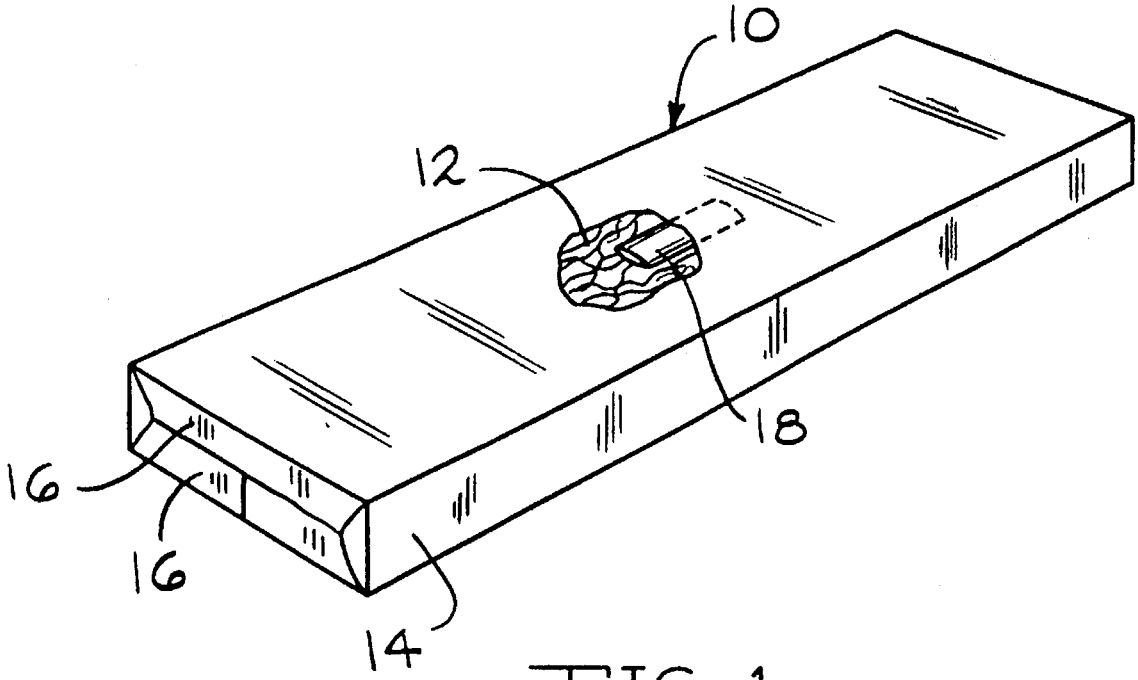
FIG. 1 is a perspective view, with parts broken away, of an improved fibrous glass insulation assembly, according to the present invention.

Referring to FIG. 1, an improved fibrous glass insulation assembly 10, according to the present invention, includes a fibrous glass body 12, such as a fibrous glass wool batt. The body 12 is enclosed by a moisture barrier, such as a plastic outer layer 14. In one embodiment, the plastic outer layer 14 is a polyethylene layer having a thickness of between about 0.3 mil and about 3 mil, thereby forming a water vapor or moisture barrier, with respect to the fibrous glass body 12. High density polyethylene is preferred, as it is a better moisture barrier than low density polyethylene. While the material used for the moisture barrier is disclosed as a polyethylene plastic, different plastics and even other types of materials which suitably retard the passage of moisture therethrough can be used.

The body 12 is placed in a substantially recoverable compressed state before being shipped and/or stored, in order to save space. That is, the body 12 is compressed only to the point that its recovered thickness, when the compression is released, provides the insulation properties desired for the end use of the assembly 10. The body 12 is compressed either before or after the moisture barrier layer 14 is applied, depending on whether the layer 14 is to be removed from the body 12 or not when the assembly 10 is installed. If it is to be removed, the moisture barrier layer 14 can used to maintain the body 12 in its compressed state. The assembly 10 is shown in FIG. 1 with its fibrous glass body 12 in an uncompressed state.

A desiccant is positioned within the outer plastic layer 14, adjacent the fibrous glass body 12. The desiccant is preferably provided in sufficient quantities to absorb the moisture necessary to improve the recovery performance of the fibrous glass body 12, from a recoverable compressed state, and to improve the overall stiffness of the fibrous glass body 12, when recovered and in an uncompressed state. The acceptable threshold level of moisture in the fibrous glass body 12 will likely vary. The minimum amount and distribution of the desiccant needed to keep the moisture level below a particular threshold moisture level can be ascertained by simple trial and error experimentation, for example, by varying the amount and distribution of the desiccant and observing the resulting recovery performance and stiffness.

In the FIG. 1 embodiment, the desiccant comprises a plurality of pouches 18 in sufficient size and quantity to reduce the relative humidity of the fibrous glass body 12 to below the threshold moisture level. The pouches 18 are formed from moisture permeable materials, such as a moisture permeable paper. Desiccants are contained within the pouches 18. One preferred desiccant is a granular anhydrous calcium sulfate ($CaSO_4$) which is sold under the trademark "DRIERITE" by W. A. Hammond Drierite Co., Xenia, Ohio. Desiccants which can be used in accordance with the present invention are listed below in Table I.

TABLE I

LIST OF DESICCANTS

| |
|---|
| $CaSO_4$ anhydrous |
| $CaCl_2$ fused |
| $CaCl_2$ granular |
| $P_2O_5$ |
| CaO |
| BaO |
| $Al_2O_3$ |
| NaOH sticks |
| KOH fused |
| $H_2SO_4$ |
| $CaBr_2$ |
| $ZnCl_2$ |
| $Ba(ClO_4)_2$ |
| $ZnBr_2$ |
| Molecular Sieves |

While the assembly 10 of FIG. 1 is shown with a fibrous glass wool rectangular body 12, the body of assembly 10 can have several configurations. For example, different end configurations may be used in the insulation assembly 10, according to the present invention. In some embodiments, the assembly 10 includes opposite ends 16 that are sealed with end flaps of the plastic outer layer 14 (see FIG. 1), thereby fully enclosing the body 12 in the moisture layer 14.

In other embodiments, the plastic layer 14 on at least one end 16 of the assembly 10 does not include such a sealed end flap and is otherwise open to expose the body 12 to the atmosphere. With this latter embodiment, the effective opening to exposed glass fibers at each end 16 is less when body 12 is compressed, compared to when body 12 is recovered, in its uncompressed state. With an effectively smaller opening, the ingress of moisture into the body 12 from the atmosphere through an open end 16 will be less when the body 12 is compressed. Thus, for an assembly 10 having one or more open ends 16, the ability of the desiccant to control the moisture content in the body 12 is improved when the body 12 is in its compressed state.

Figure 1A:
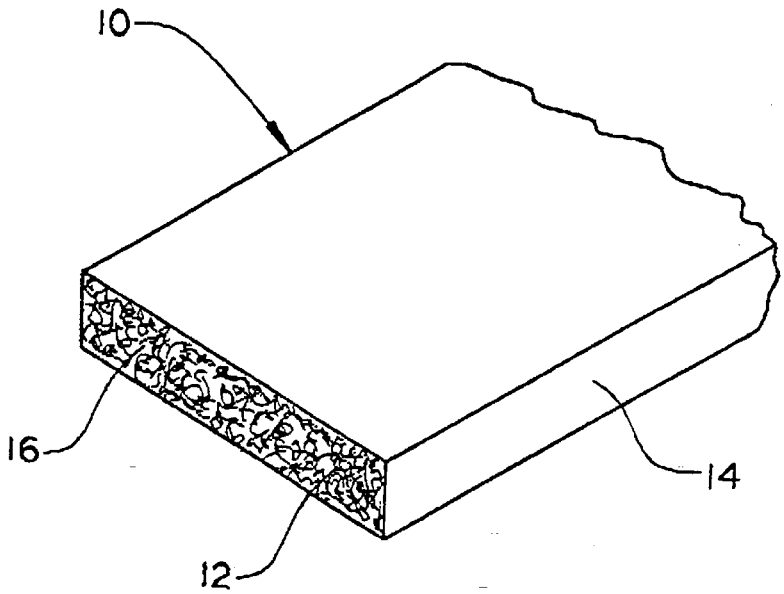
FIG. 1A is a perspective view of one end of the assembly of FIG. 1, with the moisture barrier layer being modified to be open at the one end.
Figure 1B:
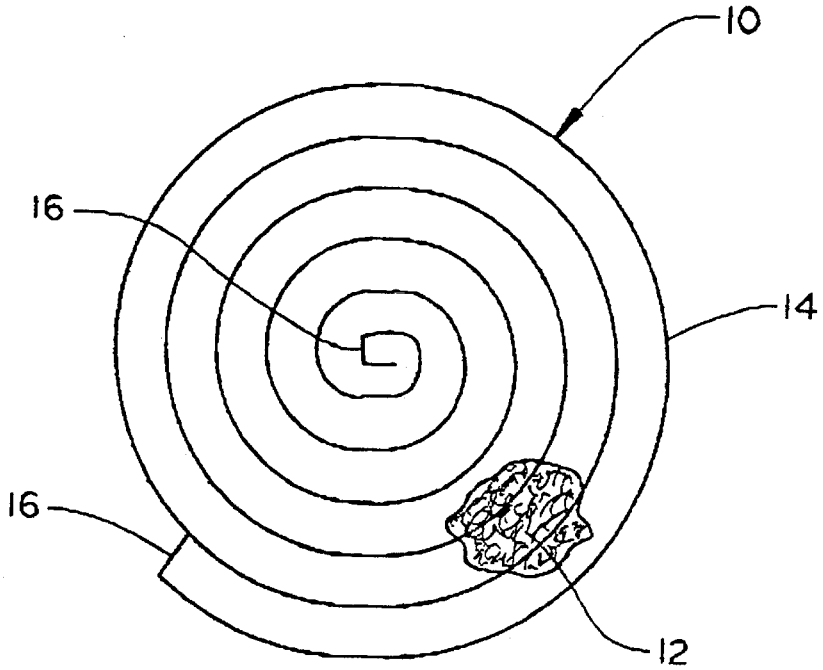
FIG. 1B is a side view, with parts broken away, of an elongated version of the assembly of FIG. 1 in the form of a roll.

Referring to FIG. 1B, another configuration of assembly 10 can have an elongated body 12 either fully or partially enclosed by a correspondingly elongated moisture barrier layer 14. The elongated body 12 can be rolled, as shown in FIG. 1A, or folded lengthwise one or more times, like that shown in FIG. 3. The body 12 is enclosed by the moisture barrier layer 14 either before or after the body 12 is rolled or folded. The body 12 is typically compressed while it is being rolled or after it is folded. In that case, if the body 12 is enclosed in the plastic layer 14 after being rolled or folded, then the layer 14 is removed before installation.

For a rolled assembly 10 (see FIG. 1B) that is open at both ends 16 (see FIG. 1A), only the free end 16 is open to the atmosphere. Because it is at the center of the roll, the opposite open end 16 of such a rolled assembly 10 is effectively enclosed by a portion of the plastic layer 14 enclosing the balance of the body 12. Thus, winding such an open ended assembly 10 into a roll effectively results in less moisture entering the body 12 from the atmosphere. As a consequence, the amount of desiccant needed can be reduced. In addition, an assembly 10 that is rolled-up is typically packaged, individually or in a group, to keep the assembly 10 from unrolling. Thus, the packaging could also be chosen so as to effectively close-off the free open end 16 of the rolled assembly 10 from the atmosphere.

Figure 2:
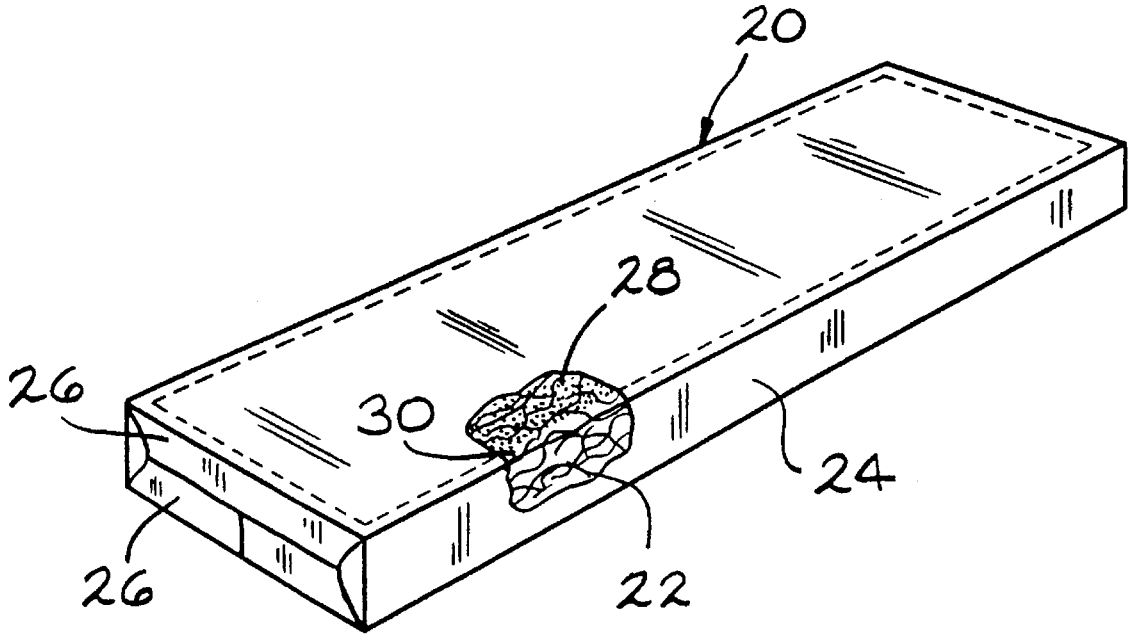
FIG. 2 is a perspective view, similar to FIG. 1 of another embodiment of an insulation assembly, according to the present invention.

Another embodiment of a fibrous glass insulation assembly, according to the present invention, is indicated by the reference number 20 in FIG. 2. The fibrous glass insulation assembly 20 includes a fibrous glass body 22 and a plastic layer 24 having end flaps 26. The end flaps 26 are sealed and the plastic outer layer 24 forms a vapor barrier relative to the fibrous glass body 22. The fibrous glass insulation assembly 20 also includes a desiccant. In the present embodiment the desiccant comprises a desiccant layer 28 that can be sprayed or otherwise applied on an upper surface 30 of the fibrous glass body 22. The desiccant layer 28 is comprised of anhydrous calcium sulfate ($CaSO_4$). Other desiccants listed above in Table I may also be utilized to form the desiccant layer 28.

Figure 3:
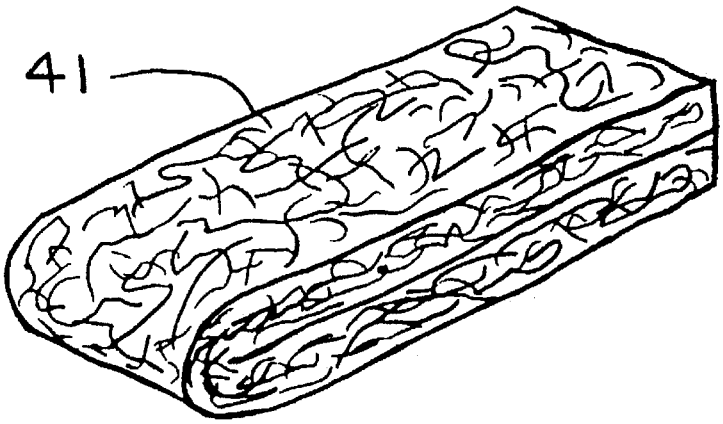
FIG. 3 is a perspective view of a fibrous glass insulation batt, which has been folded.
Figure 4:
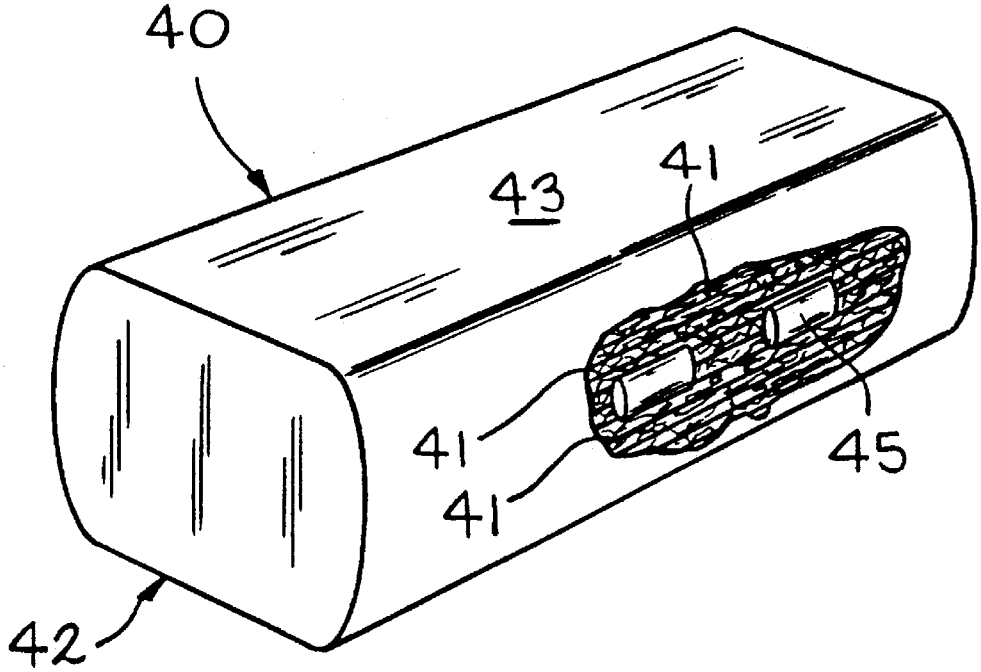
FIG. 4 is still another embodiment of an insulation assembly, according to the present invention.

Referring to FIG. 4, a fibrous glass insulation package, according to the present invention is indicated by the reference number 40. An exemplary fibrous glass batt or body 41 is shown in FIG. 3. The batt 41 is uncovered, has been folded in half and is in an uncompressed state. The assembly 40 includes a plurality of fibrous glass batts 41 which have been compressed and positioned within a package 42 comprising, for example, a plastic bag or outer layer 43. The plastic bag 43 can function as the moisture barrier for the plurality of fibrous glass batts 41 enclosed therein. It is also contemplated that each of the batts 41 may be enclosed by a separate moisture barrier layer, similar to layer 14, and the plurality of separately enclosed glass batts positioned within a single package which may or may not form an additional moisture barrier.

A desiccant, for example, comprising a plurality of pouches 45 is positioned within the bag 43. The pouches 45 are formed from moisture permeable materials, such as a moisture permeable paper. A desiccant is contained within each pouch 45. A preferred desiccant is granular anhydrous calcium sulfate ($CaSO_4$). Other desiccants which may be used are listed above in Table I.

When the insulation assembly 40 is taken to a job site, the bag 43 is removed and the batts 41 recover. It is not unusual for the recovered thickness of the batts 41 to be five or six times the thickness of the compressed batts 41.

The desiccant pouches 45 lower the relative humidity within the bags 43 during storage. It has been found that the use of a desiccant in a fibrous glass insulation assembly unexpectedly improves recovery performance, namely, the recovered thickness of a compressed fibrous glass insulation assembly upon being opened, after a long-term storage. The recovery improvement is often about 15 percent better than assemblies which do not include desiccants.

From the above disclosure of the general principles of the present invention and the preceding detailed description, those skilled in this art will readily comprehend the various modifications to which the present invention is susceptible. Therefore, the scope of the invention should be limited only by the following claims and equivalents thereof.

What is claimed is:

1. A non-evacuated fibrous glass insulation assembly (10) comprising:

at least one fibrous glass body (12);

a moisture barrier (14) substantially enclosing said at least one fibrous glass body (12); and a desiccant (18) positioned within said moisture barrier (14) and adjacent said fibrous glass body (12) for removing moisture from said fibrous glass body (12).

2. The insulation assembly (10) of claim 1, wherein said fibrous glass body (12) is in a recoverable compressed state.

3. The insulation assembly (10) of claim 1, wherein said fibrous glass body (12) has an end (16) and said moisture barrier (14) does not enclose said end (16).

4. The insulation assembly (10) of claim 3, wherein said fibrous glass body (12) is in the form of a roll.

5. The insulation assembly (10) of claim 3, wherein said fibrous glass body (12) is folded.

6. The insulation assembly (10) of claim 1, wherein said fibrous glass body (12) has opposite ends (16) and said moisture barrier (14) does not enclose either of said opposite ends (16).

7. The insulation assembly (10) of claim 1, wherein said moisture barrier (14) comprises a pliable layer that is readily formable around said fibrous glass body (12).

8. The insulation assembly (10) of claim 1, wherein said moisture barrier (14) sufficiently retards the passage of moisture into said fibrous glass body (12) and said desiccant (18) removes enough moisture from said fibrous glass body (12) to improve the recovery performance of said fibrous glass body (12) from a compressed state to an uncompressed state.

9. The insulation assembly (10) of claim 1, wherein said moisture barrier (14) sufficiently retards the passage of moisture into said fibrous glass body (12) and said desiccant (18) removes enough moisture from said fibrous glass body (12) to improve the stiffness of said fibrous glass body (12).

10. The insulation assembly (10) of claim 1, wherein said at least one fibrous glass body (12) is a plurality of fibrous glass bodies (12), said moisture barrier (14) is a plurality of moisture barrier layers (14), each of said fibrous glass bodies (12) is substantially enclosed by at least one of said moisture barrier layers (14) and said plurality of fibrous glass bodies (12) are contained in a package (42).

11. The insulation assembly (10) of claim 10, wherein each of said plurality of fibrous glass bodies (12) is maintained in a substantially recoverable compressed state by at least one corresponding moisture barrier layer (14).

12. The insulation assembly (10) of claim 10, wherein said package (42) maintains said plurality of fibrous glass bodies (12) in a substantially recoverable compressed state.

13. A readily foldable insulation assembly (10) comprising:

a flexible fibrous glass body (12) adapted for being substantially recoverable from a compressed state and having an end (16);

a moisture barrier layer (14) substantially enclosing said fibrous glass body (12), excluding at least said end (16); and a desiccant (18) positioned within said moisture barrier layer (14) and adjacent said fibrous glass body (12) for removing moisture from said fibrous glass body (12).

14. The insulation assembly (10) of claim 13, wherein said fibrous glass body (12) is in a compressed state and in the form of a roll.

15. The insulation assembly (10) of claim 13, wherein said fibrous glass body (12) is in a recoverable compressed state and folded.

16. The insulation assembly (10) of claim 15, wherein said fibrous glass body (12) is folded a plurality of times.

17. A fibrous glass insulation assembly (40) comprising:

a plurality of foldable fibrous glass bodies (41) in a recoverable compressed state;

a moisture barrier (43) around said fibrous glass bodies (41); and a desiccant (45) positioned within said moisture barrier (43) and adjacent each of said fibrous glass bodies (41) for removing enough moisture to improve the recovery performance of each of said fibrous glass bodies (41).

18. The insulation assembly (40) of claim 17, wherein said moisture barrier (43) comprises a package (42) containing said fibrous glass bodies (41).

19. The insulation assembly (40) of claim 18, wherein said fibrous glass bodies (41) are maintained in their recoverable compressed state by a package (42) containing said fibrous glass bodies (41).

20. The insulation assembly (40) of claim 17, wherein said moisture barrier (43) is a plurality of moisture barrier layers (14), and each of said fibrous glass bodies (41) is substantially enclosed by at least one of said moisture barrier layers (14).

* * * * *